US005930974A

United States Patent [19]

Zielinski

[11] Patent Number: 5,930,974

[45] Date of Patent: Aug. 3, 1999

[54] APPARATUS AND METHOD FOR TILING FLOORS

[76] Inventor: Michael A. Zielinski, 52 Columbia Ave., Colonia, N.J. 07067

[21] Appl. No.: 09/081,400

[22] Filed: May 19, 1998

Related U.S. Application Data

[60] Provisional application No. 60/050,319, Jun. 20, 1997.

[51] Int. Cl.[6] ..... E04F 21/00

[52] U.S. Cl. ..... 52/747.11; 52/749.11; 52/262; 52/DIG. 1; 182/222

[58] Field of Search ..... 52/749.11, 747.11, 52/262, DIG. 1, 384, 390, 506.01; 182/222

[56] References Cited

U.S. PATENT DOCUMENTS 2,614,664 10/1952 Sherron ..... 52/262

5,363,560 11/1994 Makow ..... 52/DIG. 1 X

FOREIGN PATENT DOCUMENTS 2351-228 12/1977 France ..... 52/749.11

*Primary Examiner*—Christopher Kent
*Assistant Examiner*—Brian E. Glessner
*Attorney, Agent, or Firm*—Lerner, David, Littenberg, Krumholz & Mentlik, LLP

[57] ABSTRACT

A platform and support permit one to walk over freshly tiled areas before the bonding agent cures, without disturbing or shifting the tiles. The support is arranged in the grout joints between tiles and is supported by the subfloor, not the tiles. The platform rests on the supports to provide a larger area for one to walk or stand on. The support is of a height which is at least as great as the height of the set tile. Platforms can cover one tile only or cover several tiles.

21 Claims, 2 Drawing Sheets

APPARATUS AND METHOD FOR TILING FLOORS

This application claims benefit of 60/050,319 filed Jun. 20, 1997.

BACKGROUND OF THE INVENTION

The present invention relates to the tiling of floors, and more specifically to generally permitting one to walk over freshly laid tiles without disturbing the positioning of the tiles, as well as to allow for the synergistic curing of the grouting agent and the bonding agent.

Ceramic tile, marble and the like are often set in locations in a home or in a commercial structure which temporarily render an entrance, an exit or other area inaccessible until the bonding agent (i.e., mortar or other adhesive) cures. Such locations include hallways, where stairs are often made temporarily inaccessible, or kitchens, where the kitchen itself or adjoining areas are often made temporarily inaccessible. Sometimes a long walking board can be provided from, for instance, a stairway to another untiled location. This practice has led to problems in that boards are often difficult to place, because they must be placed on untiled locations on either side of the freshly tiled floor, and can also be dangerous.

Additionally, makeshift walkways are often supported by the tiles themselves and have a tendency to shift the freshly set tile pattern. Certainly, the disruption of freshly laid tiles may result in uneven fit and inadequate adherence to the subsurface and, in the extreme, a tile job that needs to be or should be substantially reworked. Moreover, inaccessibility into important areas of the home or other structure creates equal inconvenience for the tradesman who is attempting to complete the tiling job in a timely fashion. The inaccessibility may delay completion of jobs, which could set back other contractual obligations creating a loss of income, as well as cause any number of inconveniences associated with a block of ingress and egress to these areas. Needless to say, if a contractor is able to efficiently move from a completed job to another job without having to return to the first job, the completed job will cost less in time and the contractor can pass savings to the homeowner. An apparatus and method that provides for walking over freshly set tiled areas without delay or disruption is thus desireable.

SUMMARY OF THE INVENTION

The present invention herein comprises a method of placing temporary supports between freshly set tiles and providing a board or a number of boards on top of such supports, preferably above the tile, so that one can walk across a freshly laid tile floor or kneel on the boards without shifting the freshly set tiles or disturbing the integrity of the tile/bonding agent/subfloor interface. The supports would be supported by the subfloor, and thus the boards would be supported independently of the freshly set tiles. In addition to the above, the supports can be removed from between the tile either after the tiler has grouted tiles adjacent to the board and support, or after the bonding agent has cured or at least partially cured so that the tiles will not shift or the interface will not be disturbed when walked on. This all depends upon whether the tiler will continue to work the floor, i.e., grout the joints, or whether the tiler will allow the tiles to cure or at least partially cure, yet wishes to permit access to the tiler or others where access would otherwise be prevented.

As many bonding agents cure or at least partially cure rather quickly, the tiler can arrange the supports and/or boards in place as portions of the floor to be tiled have been completed. This could provide immediate access as soon as the entire floor is tiled. That is, the tiler would not need to arrange the supports and/or boards after completing the entire floor. In this manner, by the time a tiler finishes an entire floor area, he may be able to immediately begin grouting the earlier finished portions. He can do so prior to the bonding agent curing or at least partially curing by using the supports and boards. However, if the floor has cured or partially cured, the boards can be removed in those locations only as the grouting agent is applied. If the bonding agent has not completely cured, it is possible to permit the synergistic curing of the bonding agent and the grouting agent. The simultaneous curing when the substances are wet or not completely dry will permit the formation of a stronger mass surrounding the tiles.

The invention also comprises an apparatus which includes board supports, where such board supports are constructed to be arranged between tiles and provide support independently of the tiles. The supports will not cause the tiles themselves to shift when weight is placed on them since they are supported by the subfloor. In a preferred embodiment, the supports are substantially L-shaped so that they fit around two sides of a tile, the sides of the support being equal or different in length from the corner. The supports can be placed at opposite corners of the tile. Of course, other shapes are also possible, for instance, shapes which match two or three sides of an octagonal tile can be used, or the support can be straight. To provide support, the shapes can be mixed or matched. For instance, two L-shaped supports can be used together, or one L-shaped and one straight support can be used together. Preferably, the two sides of an L-shaped support are approximately the same length as the tile around which the supports will be provided for maximizing support; but of course even short sides will serve the support function in most cases. If the supports are slightly less in length than the sides of the tile, the board supports may be easier to place in position. The board supports can vary in thickness, but approximately one-eighth of an inch is preferred so that the board supports could be used within grout lines of various thicknesses.

The apparatus also includes a board or plurality of boards. Where a plurality of boards is used, the boards may be of any suitable size. In a preferred embodiment, individual boards are slightly larger than one of the tiles about which the board supports are provided. In this manner, the individual board can lay on top of, for instance, two L-shaped board supports which are provided around a single tile. Alternatively, a walking board or a number of walking boards can be provided to lay across more than one tile on tile supports provided around more than one tile. Of course, the stiffness of the board and the number of supports being used must be considered. If a longer board is to be used over several tiles on only two or a few supports separated by a considerable distance, a stiffer board is required than if a board will rest on many closely located supports or over only a single tile or a couple of tiles.

Yet another arrangement is to provide supports already attached to an individual board. The board/support structure could even be integrally formed. This can be done with any material or materials. Plastic might be used for the entire composite piece or can be used in conjunction with a metal support molded directly into the plastic. Preferably, if this arrangement is employed, the support would only be on a limited number of sides of an individual board, for ease of placement around a tile, though a four sided support (four separate supports or all connected) to entirely surround a tile is contemplated as well. For instance, an L-shaped board support can be connected, integrally or otherwise, to an individual board so that it runs along one or two sides of a square board. An individual L-shaped board support can be used in conjunction with this piece by placing it along one or two sides of a tile. The composite board and individual support piece can be placed over the tile, with the supports attached to the board running along the other one or two sides of the tile.

The board supports and the boards can be made of any suitable material, including plastic, metal, stamped metal, wood, composites, etc.

Another aspect of the present invention includes the steps of placing temporary supports between freshly set tiles and providing a board or a number of boards on top of such supports so that the tiler can walk across a freshly laid floor, without shifting or disturbing the freshly set tiles, in order to grout the spaces between the tiles before the mortar or other adhesive has cured. Of course, once surrounding grout lines have been grouted with a grouting agent, the board and support can be removed and the grout lines previously covered by them can be grouted either from other boards and supports or from other areas (tiled or not) where tiles will not be disturbed or shifted. There are several advantages in using this method, including that the tiler does not need to leave a job, wait for the mortar or other adhesive (such as Thin-Set brand mortar) to cure or partially cure before grouting the spaces between the tiles. Thus, the tiler's time is used more efficiently. Moreover, the grout and mortar will adhere together in a solid mass because the mortar or adhesive will not yet have fully dried, and therefore when the wet grout contacts the wet mortar or adhesive (often these materials have the same base compound—cement), it will enable a solid mass to be created upon the simultaneous drying of both the mortar and grout.

With the board and board supports, various freshly tiled areas of a home or business are not rendered inaccessible while the bonding agent (i.e., tile mortar or other adhesive) cures. Thus, for example, one can walk through a hallway to a stairway on top of the boards. Once the spaces between tiles which surround the board and support have been grouted or once the bonding agent cures or at least partially cures, the boards and the supports can then be removed. The grout lines covered by the board and support would then be free from the board and support for grouting as usual. The boards and board supports can be reused for other installations.

DETAILED DESCRIPTION OF THE PREFERRED EMBODIMENT

Figure 1:
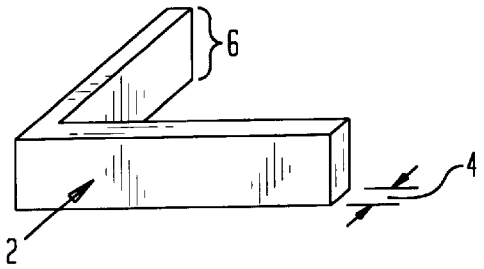
FIG. 1 is a perspective view of one embodiment of a support (somewhat exaggerated in size)
Figure 2A:
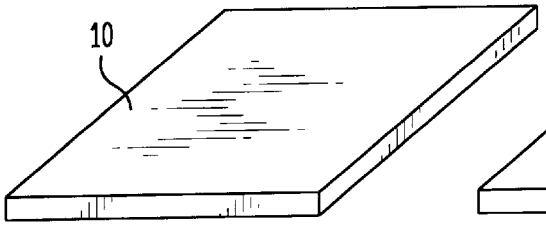
FIG. 2A is a perspective view of one embodiment of a board or platform.
Figure 2B:
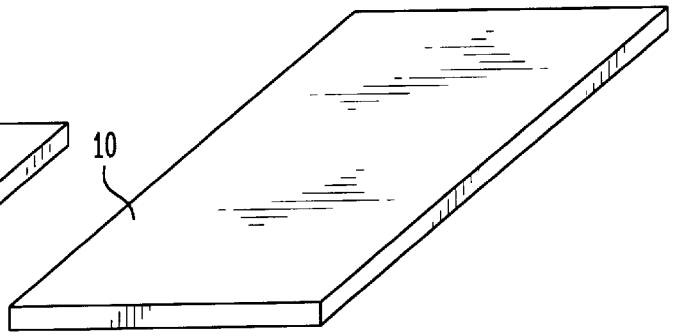
FIG. 2B is a perspective view of another embodiment of a board or platform (elongate to cover more than one tile)
Figure 4:
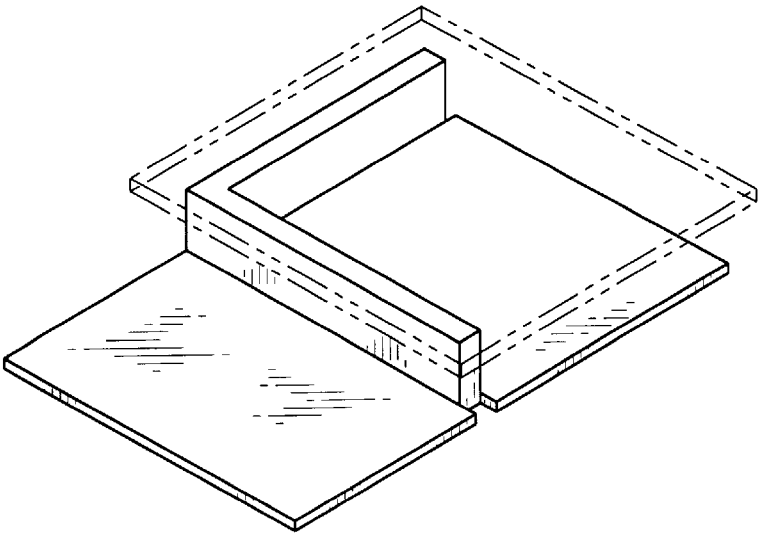
FIG. 4 is a perspective view of a platform (in dashed lines) disposed on the support positioned within the space between set tiles.

FIG. 1 shows a support 2 having a width 4 and a height 6. The support 2 is constructed to support a platform 10, as shown shown in FIGS. 2A or 2B, to establish a surface on which one could walk. The platform 10 in FIG. 2A is for covering a single tile, while the platform 10 in FIG. 2B is for covering several tiles.

The support 2 has a width 4 being smaller than the width of the space between set tiles such that the support 2 when positioned within the space between tiles rests on a subfloor. The width 4 of the support 2 need only be provided on that portion of the support 2 which will be disposed in the grout joint. The structure of the support wall or side may be tapered from larger to smaller from top to bottom, or may be stepped so that that portion which is in the grout joint is smaller in width than that portion which is above the grout joint. The width required is dictated by the space between the tiles in any particular job. A one-eighth inch width is preferable since it will fit between most grout joints.

The support 2 has a height which is preferably higher than the height of the tile. It must be at least as high as the height of the tile (as set on the floor) so that the platform 10 is supported substantially independently of the set tiles to avoid disturbing the set tiles when a user walks on the platform 10. Another advantage of the support is that in many cases it will substantially fill the grout joint and may prevent movement of the tile, particularly when the support is on opposite sides of a tile.

Figure 3:
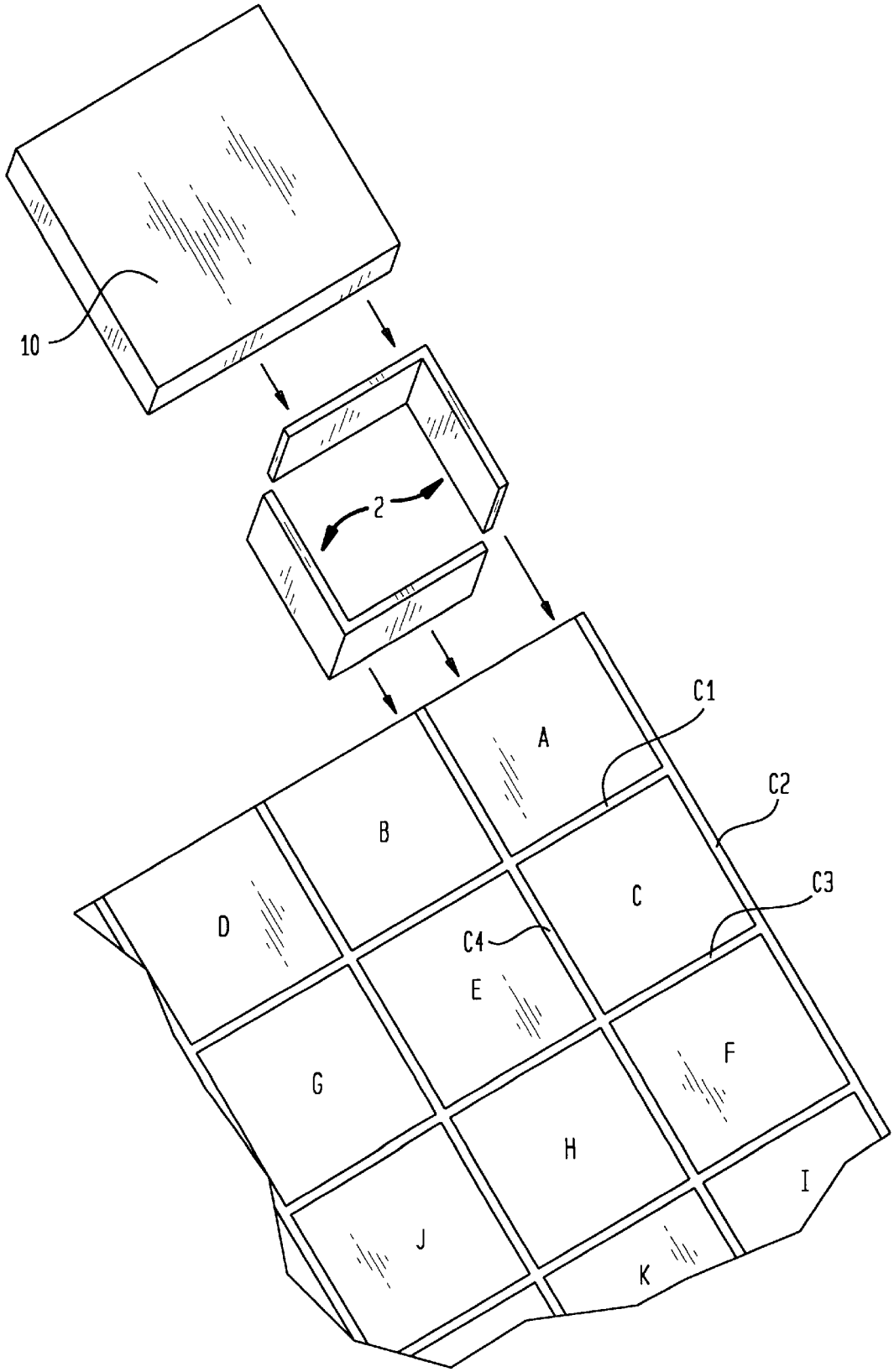
FIG. 3 is a perspective, "assembly-type" view of two L-shaped supports being placed between tiles and a board being placed thereon.

As shown in FIG. 3, tiles A, B, C, D, E, F, G, H, I, J and K are freshly set and have grout lines therebetween. Two L-shaped supports 2 are provided to surround the tile or at least provide support at opposite corners of a square tile. The sides of the supports need not be the entire length of a side of a tile, but rather can be somewhat shortened for ease of placement, or may be lengthened so as to extend along the side of more than one tile. In this regard, a support might be provided which has a side with a length that covers, for instance, the sides of two tiles, and another side which is shorter than even the side of one tile. Any combination can be provided as long as the appropriate support is provided. A support may even have sides having short lengths, for instance, a quarter of the side of a tile.

In FIG. 3, the supports are to be provided in grout joints C1, C2, C3 and C4. This surrounds tile C. The platform are to be provided on the supports 2, and this provides a sufficient support for one to stand, walk or kneel. One can then step from the non-tiled area adjacent to tiles A, B and D directly onto platform 10 at the location of tile C. Of course, a longer platform can be used, for instance from tile C to tile J, or any other combination of tiles, so long as support are provided at appropriate areas given the stiffness of the board used as platform 10.

A plurality of the platforms 10 disposed on a series of the supports 2 may be used to cover an area to allow a user to begin, continue and finish grouting a freshly set tiled area before the mortar or other adhesive has dried.

While the foregoing description and figures illustrate and describe the referred embodiments of the platforms and supports and methods for using same, in accordance with the present invention, it should be appreciated that certain modifications can be made and are encouraged to be made in the structure, materials and techniques of the disclosed embodiments without departing from the spirit and scope of the present invention which is intended to be captured by the claims set forth immediately below.

What is claimed is:

1. A temporary platform surface spaced tiles freshly set on a subfloor, comprising:

a. a plurality of tiles set on a subfloor, the set tiles having a tile height and there being a grout space having a width between the freshly set tiles;

b. at least one support having a height which is at least equal to the tile height, at least a portion of said support having a width which is smaller than the width of the grout space between the set tiles, said at least one support being constructed so that when it is positioned within the grout space between set tiles, said at least one support rests on the subfloor to provide support independently of the tiles; and c. a platform to be disposed on said at least one support such that said platform is supported independently of the set tiles and the set tiles are not disturbed when one walks on said platform.

2. The apparatus in claim 1, wherein said at least one support has a shape corresponding to at least two sides of the tile.

3. The apparatus in claim 1, wherein said at least one support is substantially L-shaped such that it fits around adjacent sides of a square or other shaped tile.

4. The apparatus in claim 3, wherein the two sides of said L-shaped support are approximately the same length or lengths as the two sides of the tile around which said L-shaped support is provided.

5. The apparatus in claim 3, wherein the two sides of said L-shaped support are less than the length or lengths of two sides of the tile around which said L-shaped support is provided.

6. The apparatus in claim 1, wherein at least a portion of said at least one support has a thickness of approximately one-eighth of an inch.

7. The apparatus in claim 1, wherein said platform is larger than one of the tiles about which said at least one support is provided.

8. The apparatus in claim 1, further comprising a second support.

9. The apparatus in claim 8, wherein said second support has at least the same height and at least as narrow a width as said at least one support.

10. The apparatus in claim 8 wherein said at least one support and said second support have different sizes.

11. The apparatus in claim 1, wherein said at least one support is connected to said platform such that together they form a composite support.

12. The apparatus in claim 11, wherein said at least one support is L-shaped running along two sides of a square platform, and is integrally formed with said platform.

13. The apparatus in claim 11, further including a second individual support separate from said composite support.

14. A method of establishing a temporary platform surface above spaced tiles freshly set on a subfloor, comprising the steps of:

a. positioning at least one support within at least a portion of a grout space between freshly set tiles so that said at least one support rests on the subfloor and extends to a height at least to a height of the freshly set tiles; and b. placing a platform on top of the at least one support so that the platform is supported independently of the freshly set tiles.

15. The method in claim 14, further including the step of removing the at least one support and the platform from the tiled area after the bonding agent has cured or at least partially cured, or after tiles surrounding the support and platform have been grouted.

16. The method in claim 14, wherein said step of positioning the at least one support includes positioning a support that is L-shaped, about two sides of a tile.

17. The method according to claim 14, including the step of positioning an additional support along a side or about sides of a different tile, and wherein said step of placing the platform includes positioning a platform to lay across more than one tile on supports positioned around more than one tile.

18. The method in claim 14, wherein said step of positioning the at least one support and placing a platform includes positioning a platform and at least one support as a composite support, whereby the at least one support is connected to said platform.

19. The method in claim 14, wherein the support and platform are integrally formed.

20. A method of tiling a floor comprising the steps of:

a. positioning tile on a subfloor with a bonding agent therebetween;

b. positioning at least one support within at least a portion of a grout space between freshly set tiles so that said at least one support rests on the subfloor and extends to a height at least equal to a height of the freshly set tiles;

c. placing a platform on top of the at least one support so that the platform is supported independently of the freshly set tiles;

d. grouting the grout spaces between tiles, at least a portion of the grouting being accomplished while on the platforms; and e. removing the platform and the at least one support.

21. The method in claim 20, wherein steps d. and e. are performed in that order.

* * * * *

UNITED STATES PATENT AND TRADEMARK OFFICE
CERTIFICATE OF CORRECTION

PATENT NO. : 5,930,974

DATED : August 3, 1999

INVENTOR(S) : Michael A. Zielinski

It is certified that error appears in the above-identified patent and that said Letters Patent is hereby corrected as shown below:

Column 4, line 1, cancel the word "shown".
Column 4, line 40, "platform are" should read –platform is--.
Column 4, line 47, "support" should read --supports--.
Column 4, line 63, after "platform surface" insert --above--.

Signed and Sealed this

Eighth Day of February, 2000

*Attest:*

*Attesting Officer*

Q. TODD DICKINSON

*Commissioner of Patents and Trademarks*